US011613958B1

(12) United States Patent
Coronado et al.

(10) Patent No.: US 11,613,958 B1
(45) Date of Patent: Mar. 28, 2023

(54) DOWNHOLE TOOL WITH BACKUP RING ASSEMBLY

(71) Applicant: The WellBoss Company, LLC, Houston, TX (US)

(72) Inventors: Martin P. Coronado, Fulshear, TX (US); Derek Slater Payne, Katy, TX (US)

(73) Assignee: The WellBoss Company, LLC, Houston, TX (US)

( * ) Notice: Subject to any disclaimer, the term of this patent is extended or adjusted under 35 U.S.C. 154(b) by 0 days.

(21) Appl. No.: 17/576,682

(22) Filed: Jan. 14, 2022

Related U.S. Application Data

(60) Provisional application No. 63/276,583, filed on Nov. 6, 2021.

(51) Int. Cl.
*E21B 33/128* (2006.01)
*E21B 23/06* (2006.01)
*E21B 33/12* (2006.01)

(52) U.S. Cl.
CPC ..... *E21B 33/128* (2013.01); *E21B 23/06* (2013.01); *E21B 33/1216* (2013.01)

(58) Field of Classification Search
CPC ..... E21B 33/128; E21B 23/06; E21B 33/1216
See application file for complete search history.

(56) References Cited

U.S. PATENT DOCUMENTS

| | | | | |
|---|---|---|---|---|
| 5,961,123 | A | 10/1999 | Ingram et al. | |
| 6,041,858 | A | 3/2000 | Arizmendi | |
| 8,910,722 | B2 | 12/2014 | Bishop et al. | |
| 9,228,411 | B2 | 1/2016 | Themig | |
| 9,845,658 | B1 * | 12/2017 | Nish | E21B 33/128 |
| 10,570,694 | B2 * | 2/2020 | Davies | E21B 33/134 |
| 2004/0069502 | A1 | 4/2004 | Luke | |
| 2009/0255690 | A1 * | 10/2009 | Conner | E21B 33/1216 166/387 |
| 2014/0020911 | A1 * | 1/2014 | Martinez | E21B 33/129 166/134 |
| 2015/0275619 | A1 | 10/2015 | Slup | |
| 2016/0123100 | A1 | 5/2016 | Tse | |
| 2017/0044859 | A1 * | 2/2017 | Blair | E21B 23/06 |
| 2017/0260824 | A1 * | 9/2017 | Kellner | E21B 33/1293 |
| 2019/0330956 | A1 | 10/2019 | Urban, II et al. | |

* cited by examiner

*Primary Examiner* — Yong-Suk (Philip) Ro
(74) *Attorney, Agent, or Firm* — Kearney, McWilliams & Davis, PLLC; John M. DeBoer

(57) ABSTRACT

A downhole tool suitable for use in a wellbore, the tool having a chassis or mandrel, with a center element and a plurality of support elements disposed therearound. The downhole tool also includes a first fingered member, and a second fingered member. In a run-in configuration, the first fingered member has a slot axially aligned with a midpoint of a finger of the second fingered member.

18 Claims, 9 Drawing Sheets

DOWNHOLE TOOL WITH BACKUP RING ASSEMBLY

STATEMENT REGARDING FEDERALLY SPONSORED RESEARCH OR DEVELOPMENT

Not applicable.

BACKGROUND

Field of the Disclosure

This disclosure generally relates to downhole tools and related systems and methods used in oil and gas wellbores. More specifically, the disclosure relates to a downhole system and tool that may be run into a wellbore and useable for wellbore isolation, and methods pertaining to the same. In particular embodiments, the downhole tool may be an open hole packer. The downhole tool may include a backup ring assembly.

Background of the Disclosure

An oil or gas well includes a wellbore extending into a subterranean formation at some depth below a surface (e.g., Earth's surface), and is usually lined with a tubular, such as casing, to add strength to the well. Many commercially viable hydrocarbon sources are found in "tight" reservoirs, which means the target hydrocarbon product may not be easily extracted. The surrounding formation (e.g., shale) to these reservoirs typically has low permeability, and it is uneconomical to produce the hydrocarbons (i.e., gas, oil, etc.) in commercial quantities from this formation without the use of drilling accompanied with fracing operations.

Fracing now has a significant presence in the industry, and is commonly understood to include the use of some type of plug set in the wellbore below or beyond the respective target zone, followed by pumping or injecting high pressure frac fluid into the zone. For economic reasons, fracing (and any associated or peripheral operation) is now ultra-competitive, and in order to stay competitive innovation is paramount.

FIG. 1 illustrates a conventional plugging system 100 that includes use of a downhole tool 102 used for plugging a section of the wellbore 106 drilled into formation 110. The tool or plug 102 may be lowered into the wellbore 106 by way of workstring 112 (e.g., e-line, wireline, coiled tubing, etc.) and/or with setting tool 117, as applicable. The tool 102 generally includes a body 103 with a compressible seal member 122 to seal the tool 102 against an inner surface 107 of a surrounding tubular, such as casing 108. The tool 102 may include the seal member 122 disposed between one or more slips 109, 111 that are used to help retain the tool 102 in place.

In operation, forces (usually axial relative to the wellbore 106) are applied to the slip(s) 109, 111 and the body 103. As the setting sequence progresses, slip 109 moves in relation to the body 103, and slip 111, the seal member 122 is actuated, and the slips 109, 111 are driven against corresponding conical surfaces 104. This movement axially compresses and/or radially expands the compressible member 122, and the slips 109, 111, which results in these components being urged outward from the tool 102 to contact the inner wall 107. In this manner, the tool 102 provides a seal expected to prevent transfer of fluids from one section 113 of the wellbore across or through the tool 102 to another section 115 (or vice versa, etc.), or to the surface. Tool 102 may also include an interior passage (not shown) that allows fluid communication between section 113 and section 115 when desired by the user. Oftentimes multiple sections are isolated by way of one or more additional plugs (e.g., 102A).

In many cases, multiple sections of the formation are desirably fractured either simultaneously or in stages. A workstring for the fracing of multiple stages of a formation may include one or more frac tools separated by one or more packers. In some circumstances frac systems are deployed in cased wellbores as shown in FIG. 1A, in which case perforations are provided in the casing to allow stimulation fluids to travel through the tool and the perforated casing to stimulate the formation beyond. In other cases, fracing is conducted in uncased, open holes.

FIG. 1B illustrates a conventional plugging system 100 that includes use of a downhole tool 102*a* used for plugging an open hole section of the wellbore 106 drilled into formation 110. In this embodiment, the downhole tool 102*a* may be a packer, such as an open hole packer. There may be a plurality of packers 102*a*. The downhole tool(s) 102*a* may be deployed into the wellbore 106 via a workstring 112. The workstring 112 may include other components, such as a float shoe or guide 116 at the toe (of the liner or bore), an activation tool 118 (which may be at a pre-determined distance from the guide shoe 116), a first stage frac valve tool 120, and then a series of tools other tools 102*a* alternated with subsequent stage frac valve tools 122 to a final tool, such as a cased hole packer 124. It would be understood by a person of ordinary skill in the art that FIG. 1B merely represents one example of a tubular fracing string of tools.

In the case of multistage, open hole fracing it is often a challenge to effectively isolate sections of the formation. This is due to the uneven inner surface of the open wellbore and the difficulty of making sufficient sealing contact between the packing elements of the packers and the surface. Conventional packers swellable types that include component material selection designed to react with wellbore fluids, and subsequently swell. Swellable packers are dependent on sufficient exposure of the swellable material to wellbore fluids that trigger swelling. The process of full packing off of the section to be fraced can take days to weeks using such swellable packers.

Inflatable packers are also known, and are packers activated by inflation of packing elements with a gas or air. Hydraulic packers are typically defined as packers in which the packing elements can be activated by hydraulic pressure from wellbore fluids. Hydraulic packers have also been used in some open hole cases; however, these types of packers typically require multiple packing elements per packer to provide sufficient contact with the open hole inner wellbore surface and to provide proper isolation for multistage packing.

High-expansion open-hole packing elements have to deal with very large extrusion gaps compared to conventional cased-hole packers. The extrusion gap is defined as the radial distance between the open-hole borehole and the packer outside diameter. As a result of this large extrusion gap, the ability to contain the elastomeric sealing elements under differential pressure when set is paramount. This requires a mechanical backup ring system which deforms under setting load and expands out to the borehole with little to no extrusion gap that would allow the elastomer to flow through. These types of systems are known to exhibit a wide array of failure modes.

FIGS. 1C, 1D, and 1E illustrate the occurrence (sequentially) of a typical failure mode(s) in a conventional packer tool that needs to seal an oversized annulus. As shown in FIG. 1C, upon initiating the setting sequence (including resultant setting forces Fs from compressing members 104*a* and 104*b*), the sealing element 122 will begin to extend laterally (extrude) into the tool annulus 190. However, because the lateral distance between the tool 102 and the surrounding surface 107 (of surrounding tubular or bore 106) is greater, more of the sealing element 122 must be extruded. Because more material must be extruded in order to traverse the distance to the casing, more compression is required, as shown in FIG. 1D.

Eventually, the extrusion distance is so great that the entire sealing element 122 is compressed and extruded in its entirety from the tool 102. In the alternative, in the event the sealing element 122 makes some minimal amount of sealing engagement with the tubular surface 107, the seal 125 is weak, and a minimum amount of pressure in the annulus (or annulus pressure Fa) 'breaks' the seal and/or 'flows' the sealing element 122 away from the tool 102, as shown in FIG. 1E.

Accordingly, there are needs in the art for novel systems and methods for isolating wellbores in a fast, viable, and economical fashion. Moreover, it remains desirable to have a downhole tool that provides a robust and reliable annulus seal against a wellbore surface, without no or nil likelihood of seal extrusion. There is a great need in the art for downhole tool that forms a reliable and resilient seal against a surrounding surface that is easy to deploy, even in the presence of extreme wellbore conditions.

The ability to save cost on materials and/or operational time (and those saving operational costs) leads to considerable competition in the marketplace. Achieving any ability to save time, or ultimately cost, leads to an immediate competitive advantage.

SUMMARY

Embodiments of the disclosure pertain to a downhole tool for use in a wellbore that may include any of the following: a chassis or mandrel, a center (seal) element, a plurality of support elements, a first fingered member, a second fingered member having fingers rotatably offset from the first fingered member, and an end cap. The tool may have a backup system or assembly that includes at least two fingered members.

Embodiments herein pertain to downhole tool that may be configured to provide a desired seal annulus expansion range, and yet also be flexible enough to provide deployment using relatively low setting force. As a result of tool configuration (such as geometry of the backup ring system), a variable stiffness may be obtained when in the downhole tool is in set position. This may promote resistance to structural failure when differential pressures are applied.

Embodiments herein may utilize a downhole tool having a "nested" element design. Once the downhole tool is deployed, the backup ring system may provide (total) annular support to the center (packing) element suitable to resist extrusion.

Yet other embodiments herein may pertain to a downhole tool for use in a wellbore that may include one or more of: a packer chassis or mandrel (that may have a distal end; a proximate end; and a chassis outer surface); a central element; one or more support elements; a first fingered member comprising a plurality of fingers having respective longitudinal slots therebetween; another or second fingered member proximate the first fingered member, which may have its own second member fingers having respective midpoints; and an end cap.

The plurality of support elements, the first fingered member, and the second fingered member may be held or otherwise disposed around the chassis, and between the central element and the end cap. In aspects, the longitudinal slots of the first fingered member may be proximately aligned to the respective finger midpoints of the second fingered member.

One or both of the first fingered member and the second fingered member may have an outer annular groove formed in the region where respective member fingers extend away from a member body. This region of the member(s) may be a transition region.

In aspects, in a run-in-hole position, there may be a clearance between an outer bottom end of the second fingered member and an inner bottom end of the first fingered member. In other aspects, in a set position, the outer bottom end and the inner bottom end may be in contact.

At least one of the plurality of support elements may be proximate the second fingered member. There may be a plastic spacer is disposed between the one support element and the second fingered member.

In a set position of the downhole tool, there may be a gap formed between respective expanded second member fingers that is occluded by a first member finger proximate thereto.

In aspects, the downhole tool may be coupled with a casing string. In a set position, the downhole tool may form a seal against an external surface, such as the wellbore surface, casing, and the like.

Still other embodiments of the disclosure pertain to a downhole tool for use in a wellbore that many include a packer chassis or mandrel with one or more of: a central element disposed around the packer chassis; a plurality of support elements disposed around the packer chassis; a first fingered member disposed around the packer chassis, which may have a plurality of fingers having respective longitudinal slots therebetween; a second fingered member disposed around the packer chassis and proximate the first fingered member, which may have a plurality of second member fingers having respective midpoints; an end cap disposed around the packer chassis. The end cap may be engaged with the first fingered member.

In aspects, the plurality of support elements, the first fingered member, and the second fingered member may be held or otherwise disposed between the central element and the end cap. The longitudinal slots of the first fingered member may be proximately aligned to the respective finger midpoints of the second fingered member. Either or both of the first fingered member and the second fingered member may include an outer annular groove formed in the region where respective member fingers extend away from a member body.

There may be another or second backup ring assembly disposed on the other end of the packer chassis. The second backup ring assembly may include a respective first fingered member, a respective second fingered member, and a respective end cap.

In operation of the tool, in a run-in-hole position, there may be a clearance between an outer bottom end of the second fingered member and an inner bottom end of the first fingered member. Analogously, in a set position, the outer bottom end and the inner bottom end are in contact.

One of the plurality of support elements may be proximate the second fingered member. There may be a plastic spacer is disposed between the one support element and the second fingered member.

In operation of the tool, in a set position, there may be a gap formed between respective expanded second member fingers is occluded by a first member finger proximate thereto.

In aspects, the downhole tool may be coupled with a casing string. In a set position, the downhole tool may form a seal against an external surface.

In still other embodiments there may be a downhole tool for use in a wellbore that includes: a packer chassis; a central element disposed around the packer chassis; a plurality of support elements disposed around the packer chassis; a first fingered member disposed around the packer chassis, and further comprising a plurality of fingers having respective longitudinal slots therebetween; a second fingered member disposed around the packer chassis and proximate the first fingered member, and further comprising a plurality of second member fingers having respective midpoints; and an end cap disposed around the packer chassis, and engaged with the first fingered member.

The plurality of support elements, the first fingered member, and the second fingered member may be held between the central element and the end cap. The longitudinal slots of the first fingered member may be proximately aligned to the respective finger midpoints of the second fingered member. Each of the first fingered member and the second fingered member comprise an outer annular groove formed in the region where respective member fingers extend away from a member body. One of the plurality of support elements is proximate the second fingered member. A plastic spacer may be disposed between the one support element and the second fingered member.

These and other embodiments, features and advantages will be apparent in the following detailed description and drawings.

BRIEF DESCRIPTION OF THE DRAWINGS

A full understanding of embodiments disclosed herein is obtained from the detailed description of the disclosure presented herein below, and the accompanying drawings, which are given by way of illustration only and are not intended to be limitative of the present embodiments, and wherein.

DETAILED DESCRIPTION

Figure 1:
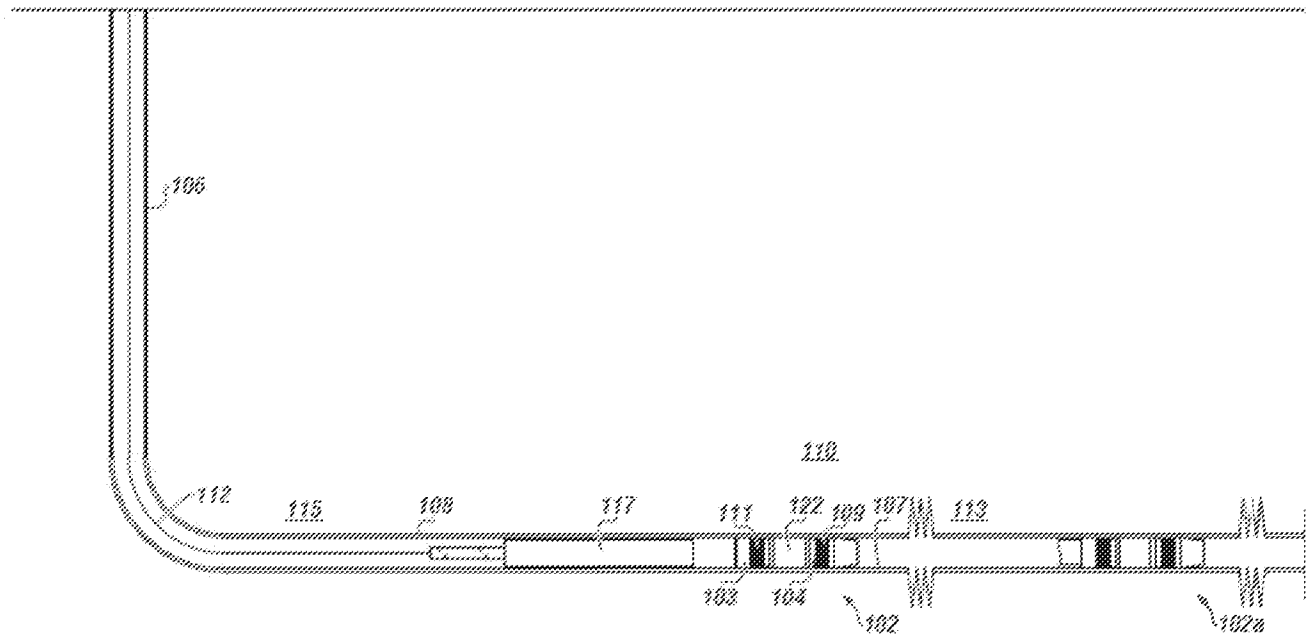
FIGURE 1 (PRIOR ART)
FIG. 1 is a side view of a process diagram of a conventional plugging system.
Figure 1B:
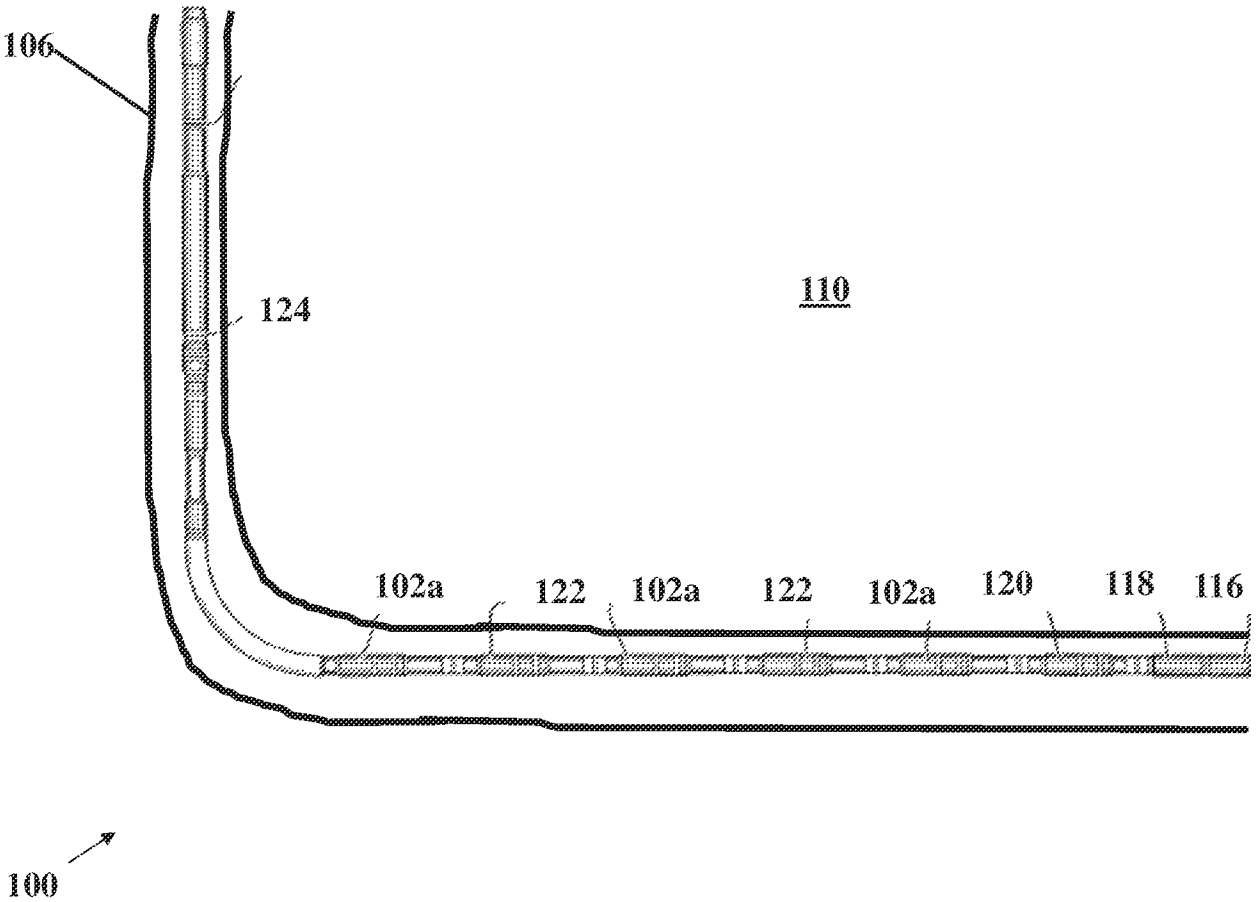
FIG. 1B (Prior Art)
FIG. 1B is a side view of a process diagram of a conventional plugging system for an open hole wellbore.
Figure 1E:
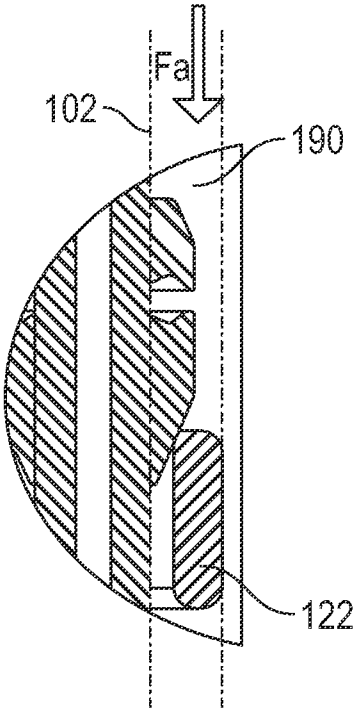
FIG. 1E (Prior Art)
FIG. 1E illustrates the occurrence of an extruded seal in a conventional packer tool.
Figure 1D:
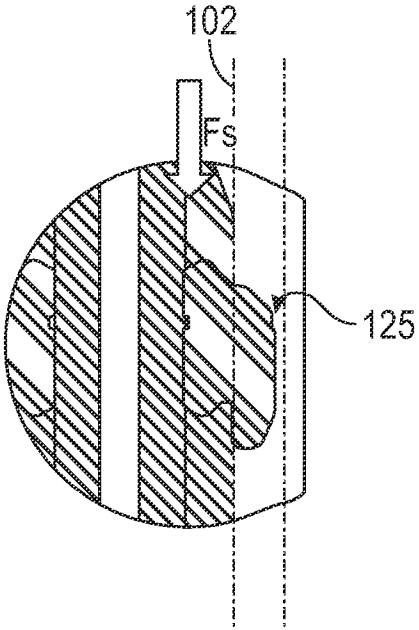
FIG. 1D (Prior Art)
FIG. 1D illustrates the occurrence of a weak seal made by a conventional packer tool.
Figure 1C:
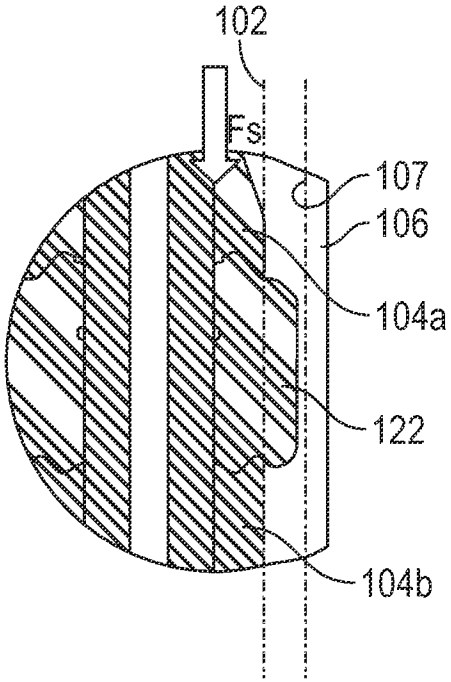
FIG. 1C (Prior Art)
FIG. 1C illustrates the deployment of a conventional packer tool that needs to seal an oversized annulus.

Herein disclosed are novel apparatuses, systems, and methods that pertain to and are usable for wellbore operations, details of which are described herein.

Embodiments of the present disclosure are described in detail in a non-limiting manner with reference to the accompanying Figures. In the following discussion and in the claims, the terms "including" and "comprising" are used in an open-ended fashion, such as to mean, for example, "including, but not limited to . . . ". While the disclosure may be described with reference to relevant apparatuses, systems, and methods, it should be understood that the disclosure is not limited to the specific embodiments shown or described. Rather, one skilled in the art will appreciate that a variety of configurations may be implemented in accordance with embodiments herein.

Although not necessary, like elements in the various figures may be denoted by like reference numerals for consistency and ease of understanding. Numerous specific details are set forth in order to provide a more thorough understanding of the disclosure; however, it will be apparent to one of ordinary skill in the art that the embodiments disclosed herein may be practiced without these specific details. In other instances, well-known features have not been described in detail to avoid unnecessarily complicating the description. Directional terms, such as "above," "below," "upper," "lower," "front," "back," "right", "left", "down", etc., are used for convenience and to refer to general direction and/or orientation, and are only intended for illustrative purposes only, and not to limit the disclosure.

Connection(s), couplings, or other forms of contact between parts, components, and so forth may include conventional items, such as lubricant, additional sealing materials, such as a gasket between flanges, PTFE between threads, and the like. The make and manufacture of any particular component, subcomponent, etc., may be as would be apparent to one of skill in the art, such as molding, forming, press extrusion, machining, or additive manufacturing. Embodiments of the disclosure provide for one or more components that may be new, used, and/or retrofitted.

Various equipment may be in fluid communication directly or indirectly with other equipment. Fluid communication may occur via one or more transfer lines and respective connectors, couplings, valving, and so forth. Fluid movers, such as pumps, may be utilized as would be apparent to one of skill in the art.

Numerical ranges in this disclosure may be approximate, and thus may include values outside of the range unless otherwise indicated. Numerical ranges include all values from and including the expressed lower and the upper values, in increments of smaller units. As an example, if a compositional, physical or other property, such as, for example, molecular weight, viscosity, temperature, pressure, distance, melt index, etc., is from 100 to 1,000, it is intended that all individual values, such as 100, 101, 102, etc., and sub ranges, such as 100 to 144, 155 to 170, 197 to 200, etc., are expressly enumerated. It is intended that decimals or fractions thereof be included. For ranges containing values which are less than one or containing fractional numbers greater than one (e.g., 1.1, 1.5, etc.), smaller units may be considered to be 0.0001, 0.001, 0.01, 0.1, etc. as appropriate. These are only examples of what is specifically intended, and all possible combinations of numerical values between the lowest value and the highest value enumerated, are to be considered to be expressly stated in this disclosure. Others may be implied or inferred.

Embodiments herein may be described at the macro level, especially from an ornamental or visual appearance. Thus, a dimension, such as length, may be described as having a certain numerical unit, albeit with or without attribution of a particular significant figure. One of skill in the art would appreciate that the dimension of "2 centimeters" may not be exactly 2 centimeters, and that at the micro-level may deviate. Similarly, reference to a "uniform" dimension, such as thickness, need not refer to completely, exactly uniform. Thus, a uniform or equal thickness of "1 millimeter" may have discernable variation at the micro-level within a certain tolerance (e.g., 0.001 millimeter) related to imprecision in measuring and fabrication.

Terms

The term "connected" as used herein may refer to a connection between a respective component (or subcomponent) and another component (or another subcomponent), which can be fixed, movable, direct, indirect, and analogous to engaged, coupled, disposed, etc., and can be by screw, nut/bolt, weld, and so forth. Any use of any form of the terms "connect", "engage", "couple", "attach", "mount", etc. or any other term describing an interaction between elements is not meant to limit the interaction to direct interaction between the elements and may also include indirect interaction between the elements described.

The term "fluid" as used herein may refer to a liquid, gas, slurry, multi-phase, etc. and is not limited to any particular type of fluid such as hydrocarbons.

The term "fluid connection", "fluid communication," "fluidly communicable," and the like, as used herein may refer to two or more components, systems, etc. being coupled whereby fluid from one may flow or otherwise be transferrable to the other. The coupling may be direct or indirect. For example, valves, flow meters, pumps, mixing tanks, holding tanks, tubulars, separation systems, and the like may be disposed between two or more components that are in fluid communication.

The term "pipe", "conduit", "line", "tubular", or the like as used herein may refer to any fluid transmission means, and may be tubular in nature.

The term "composition" or "composition of matter" as used herein may refer to one or more ingredients, components, constituents, etc. that make up a material (or material of construction). Composition may refer to a flow stream, or the material of construction of a component of a downhole tool, of one or more chemical components.

The term "chemical" as used herein may analogously mean or be interchangeable to material, chemical material, ingredient, component, chemical component, element, substance, compound, chemical compound, molecule(s), constituent, and so forth and vice versa. Any 'chemical' discussed in the present disclosure need not refer to a 100% pure chemical. For example, although 'water' may be thought of as H2O, one of skill would appreciate various ions, salts, minerals, impurities, and other substances (including at the ppb level) may be present in 'water'. A chemical may include all isomeric forms and vice versa (for example, "hexane", includes all isomers of hexane individually or collectively).

The term "mounted" as used herein may refer to a connection between a respective component (or subcomponent) and another component (or another subcomponent), which can be fixed, movable, direct, indirect, and analogous to engaged, coupled, disposed, etc., and can be by screw, nut/bolt, weld, and so forth.

The term "machined" can refer to a computer numerical control (CNC) process whereby a robot or machinist runs computer-operated equipment to create machine parts, tools and the like.

Figure 2A:
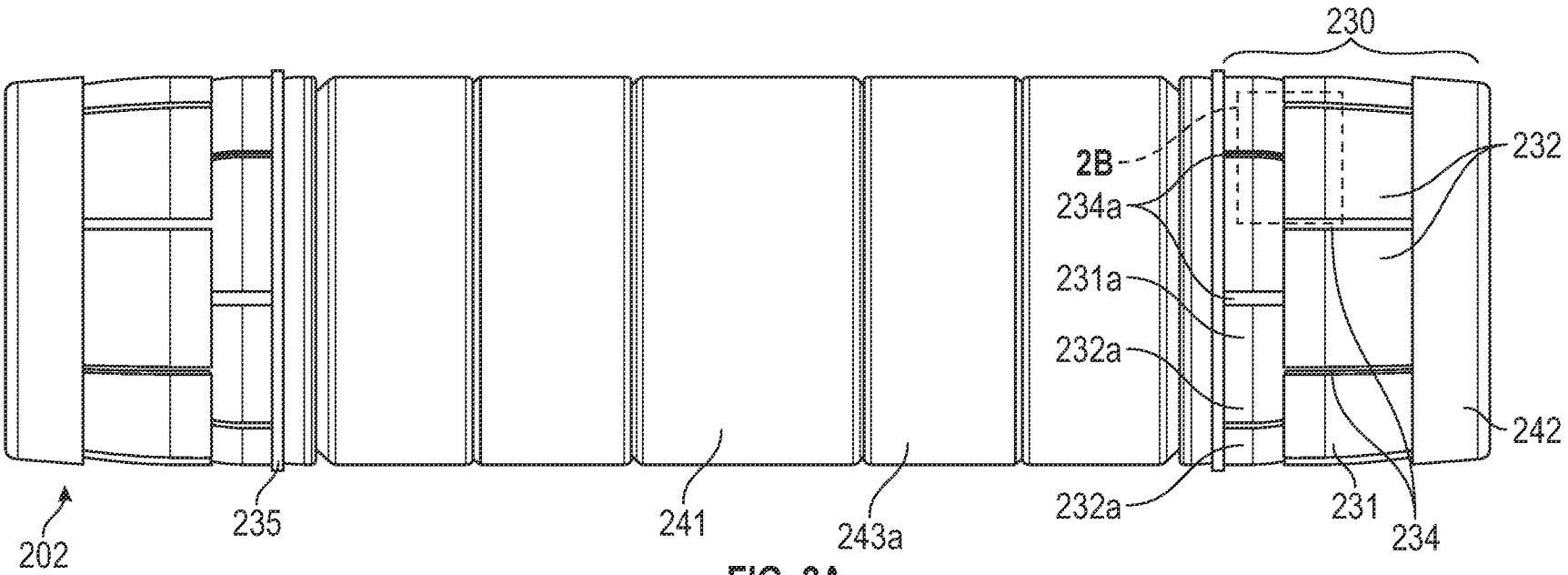
FIG. 2A shows a longitudinal side cross-sectional view of a downhole tool, according to embodiments of the disclosure.
Figure 2B:
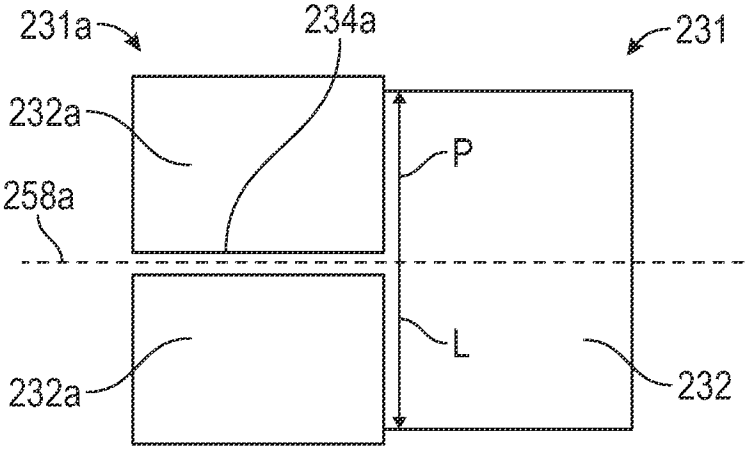
FIG. 2B shows a close-up side view of a first fingered member in staggered, nested engagement with a second fingered member, according to embodiments of the disclosure
Figure 2C:
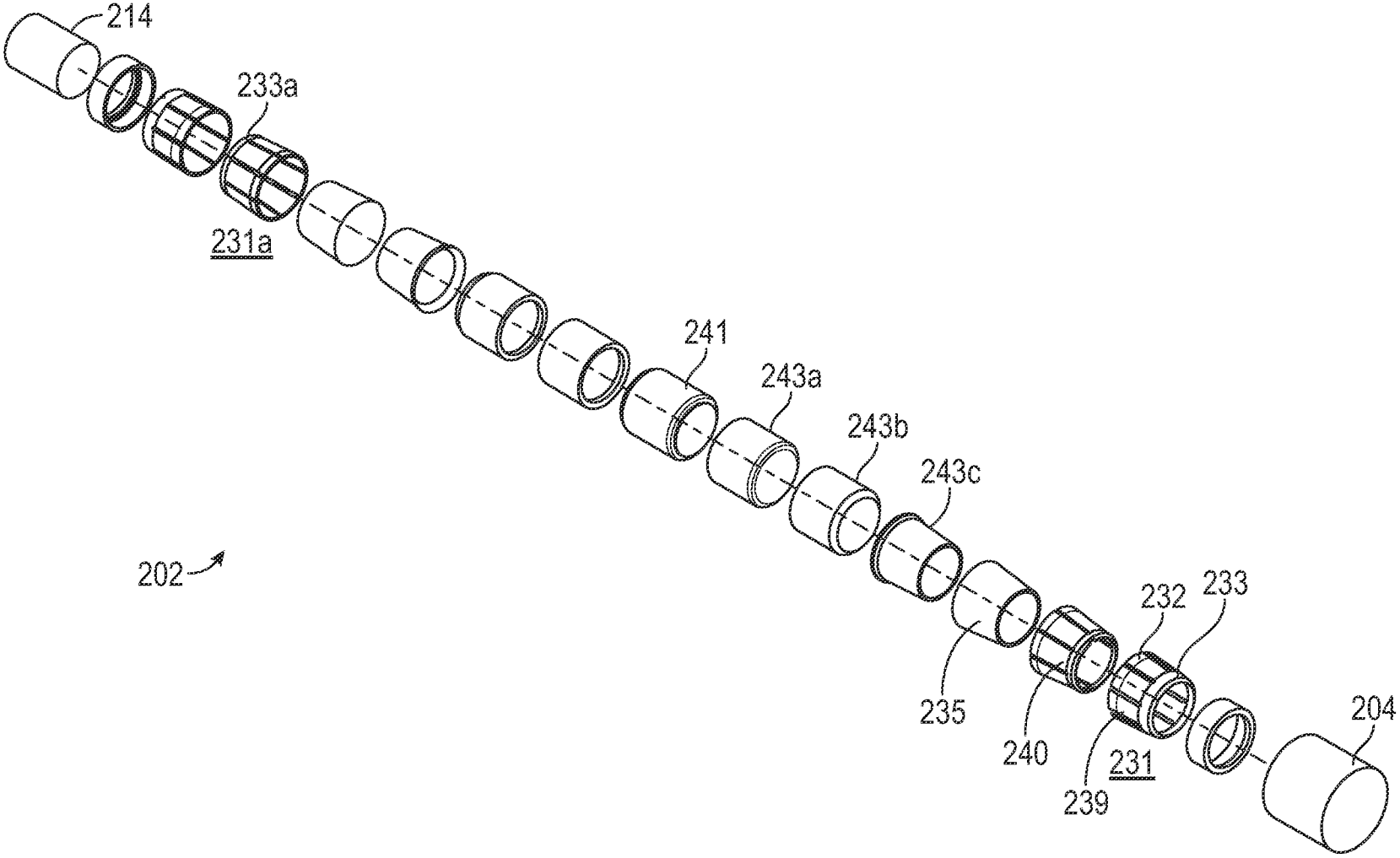
FIG. 2C shows a of the downhole tool of FIG. 2A, according to embodiments of the disclosure.

Referring now to FIGS. 2A, 2B, and 2C together, a longitudinal side cross-sectional view of a downhole tool, a close-up partial side view of a first fingered member in staggered, nested engagement with a second fingered member, and a component breakout view of the downhole tool of FIG. 2A, respectively, illustrative of embodiments disclosed herein, are shown.

Although not shown in detail here, the downhole tool 202 may be part of a system operable to deploy the tool 202 into a wellbore formed in a subterranean formation. The wellbore may have a tubular, such as casing (e.g., casing, hung casing, casing string, etc.) (which may be cemented), and the like. Just the same, the wellbore may be open hole. A workstring may be used to position or run the downhole tool 202 into and through the wellbore to a desired location. The downhole tool 202, which may be a closed or an open hole packer, may be RIH, set, and otherwise operated like that of any tool described in U.S. Pat. No. 9,995,111, incorporated herein by reference in its entirety, including in particular as it may pertain to setting or activating a downhole packer tool.

Although not limited, the downhole tool 202 may be an open hole or casing annulus packer. In embodiments, the downhole tool 202 may be a high-expansion open hole packer. In such a configuration, the downhole tool 202 may be deployed with corresponding fracing tools along a liner and deployed into the open hole section of the wellbore. The downhole tool 202 may provide for or otherwise facilitate isolation of various stages of the wellbore. Once isolated, stimulation fluid may be pumped from surface and used for stimulating sections of the formation via any variety of fracing tools. In other embodiments, the downhole tool 202 may be used in cementing (or comparable) operations.

Although not shown in detail here, the downhole tool 202 may include a mandrel 214 (shown only in part here; see also 314, FIG. 3A) having a setting piston engaged therewith. The setting piston may include one or more surfaces (e.g., shoulder) with varied diameter. There may be more than one setting piston. For example, the string may include a first piston with a first setting stroke for compressing against a first end of the tool. The string may include a second piston with a second setting stroke for compressing against the second end of the tool. The result of compressing together is the urging (radially) outwardly of one or more components.

When a piston surface is exposed pressurized fluid source, this may act on the surface, and move the piston. The force may be suitable to completely set the downhole tool 202. The piston may be a hydraulic piston, which may be integral to the mandrel. The pressure applied to the piston may be from inside the tool 202.

The downhole tool 202 may have a backup ring system 230. One of skill would appreciate that each end of the downhole tool 202 may have the backup ring system. The (backup) ring system or assembly 230 may include an at least one expansion ring or fingered member 231 (also sometimes called a backup ring or backup element). The use of the term 'fingered member' refers to the "fingers" 232 that extend from a main (annular) body 233 of the member, each pair of adjacent fingers being separated by a respective longitudinal groove 234. These fingers may sometimes be referred to as petals, segments, and the like.

There may be a second expansion ring or fingered member 231*a*. The second fingered member 231*a* may include its own plurality of second member fingers 232*a*. The fingers 232*a* may extend away from second main (annular) body 233*a*. Each finger 232*a* may be separated from an adjacent finger by a second member longitudinal groove 234*a*.

The second member 232*a* may be engaged with an underside of the first fingered member 232. Or put another way, the second member 232*a* and the first member 232 may be 'nested' together. It is worth noting that the other end of the tool 202 may have a similar or identical system 230, thus providing a symmetrical component configuration.

As mentioned, the members 231 and 231*a* may be slotted or grooved, which may provide easier expansion of the fingers. Looking at FIG. 2B, a close-up view of the members 231, 231*a* engaged in a staggered (or straddled, offset, etc.) configuration. As shown, the finger 232 may have a lateral distance L, with a midpoint P. The midpoint P may generally be, in the eye of an ordinary observer, the middle point of the lateral distance L; however, the midpoint P need not have exact mathematical precision.

The staggered configuration may include the slot 234*a* being aligned (e.g., longitudinally) with that of the midpoint P. The slot 234*a* may be aligned with the midpoint P +/−5% in rotation. One of skill would appreciate that the symmetric nature of members 231 and 231*a* may result in each respective slot of member 231*a* being aligned with a respective midpoint P of each of the fingers 232. In a similar manner, the slot 234 of member 231 may be aligned with a respective midpoint of fingers 232*a*. The configuration shown herein, with the slots in each fingered member positioned to straddle the slots from the other member, may facilitate easier expansion.

Another way to contemplate the staggered configuration is that the midpoint P may be bisected by an axis 258*a*. The slot 234*a* may, at least partially, if not in totality, align with the axis 258*a*.

Each fingered member 231, 231*a* may have a respective annular groove 239, 240. The annular groove 239, 240 may be on an outer surface of either respective body, fingers, or at the point where the fingers extend away from the body.

The presence of the grooves 239, 240 may provide for the members 231, 231*a* to deploy from the outside end of each member, which may allow the main part of each "finger" to stay relatively straight. This shape when set may provide added structural integrity in the finger section of the members 231, 231*a*, and may better resist bending backwards under high loads from a center element 241 (or other proximate elements).

This built-in hinge point in the fingered member 231, 231*a* is a unique feature, along with using in conjunction a (deformable) support ring 242. The hingeability allows expansion requiring lesser force than conventional rings without the hinge.

As the tool 202 is activated or set, the fingers 232, 232*a* may 'flower', which may result in slots 234, 234 opening up as the members 231, 231*a* are expanded. As the slots 234, 234*a* may be staggered in alignment, this may mitigate or otherwise outright eliminate any chance of any gap, allowing for superior elastomer retention.

The members 231, 231*a* may be made from highly ductile material, such as AISI 1018 steel. Such a material may provide form the required deformation when deployed, but offering the needed structural support. The members 231, 231*a* may be axially offset in the assembled position to allow fuller extent of the members when the tool 202 is in the set position.

The end cap or ring 242 may also be deformable; however, the amount of deformation may be to a much lesser extent than either of the members 231, 231*a*. In embodiments, end cap 242 may not be slotted. The design and function of the end cap 242 may be to supply mechanical support to the hinge areas of the member(s) 231, 231*a*, especially where the maximum bending loads may be incurred. The end cap 242 made be made from highly ductile material that may also be deformable under load, such as steel.

The center element 241 may be elastomeric. The element 241 may be proximate or otherwise adjacent to one or more adjacent elements or sections 243 *a, b, c*, etc. that may deploy independently of each other. Any of the elements 241, 243 *a, b*, etc. may be multiple-durometer. In embodiments, harder durometer elements may be used on the external ends of the tool 202, working into the softest elastomer element in the middle. The elements 243*b* and 243*c* adjacent to the member 232*a* may be the hardest. As such, the support elements 243*b* and 243*c* may provide the highest level of extrusion resistance, while the softer inboard element 243*a* may provide the best sealing properties.

Between the last element 243*c* and the second member 234*a*, there may be a spacer member 235. The spacer 235 may be a solid durable material, such as hard rubber or a plastic like Teflon (PTFE). The spacer 235 may provide protection from the fingers 232*a* biting into the element 243*c*.

The downhole tool 202, as well as its components, may be annular in nature, and thus centrally disposed or arranged with respect to a longitudinal axis 258. The components may be disposed around a chassis or mandrel 214 (partially viewable here). In accordance with embodiments of the disclosure, the tool 202 may be configured as a packer (e.g., open hole), which may be set within a wellbore in such a manner that the tool 202 forms a fluid-tight seal against a surrounding surface, such as casing or the wellbore itself. The seal may be facilitated by the center element 241 expanded into a sealing position against the surface. Once set, the downhole tool 202 may be held in place.

Operation of the downhole tool 202 may allow for fast run in of the tool 202 to isolate one or more sections of the wellbore, as well as quick and simple drill-through or dissolution to destroy or remove the tool 202.

Accordingly, in some embodiments, drill-through may be completely unnecessary. As such the downhole tool may have one or more components made of a reactive material, such as a metal or metal alloys. The downhole tool of embodiments herein may have one or more components made of a reactive material (e.g., dissolvable, degradable, etc.), which may be composite- or metal-based.

It follows then that one or more components of a tool of embodiments disclosed herein may be made of reactive materials (e.g., materials suitable for and are known to dissolve, degrade, etc. in downhole environments [including extreme pressure, temperature, fluid properties, etc.] after a brief or limited period of time (predetermined or otherwise) as may be desired). In an embodiment, a component made of a reactive material may begin to react within about 3 to about 48 hours after setting of the downhole tool.

The downhole tool (and other tool embodiments disclosed herein) and/or one or more of its components may be 3D-printed or made with other forms of additive manufacturing.

Referring now to FIGS. 3A, 3B, 3C, and 3D together, a longitudinal cross-sectional view of a downhole tool in a run-in-hole (RIH) position, a close-up side cross-sectional view of a first fingered member in a staggered, nested engagement with a second fingered member, according to embodiments of the disclosure, a longitudinal side cross-sectional view of the downhole tool in a set position, and a partial lateral view of nested finger members, respectively, illustrative of embodiments disclosed herein, are shown.

Although not shown in great detail here, the downhole tool 302 may be part of a system 300 operable to deploy the tool 302 into a wellbore 306 formed in a subterranean formation. The wellbore 306 may have a tubular, such as casing (e.g., casing, hung casing, casing string, etc.) (which may be cemented), and the like. Just the same, the wellbore 306 may be open hole. A workstring 312 may be used to position or run the downhole tool 302 into and through the wellbore 306 to a desired location. The workstring 312 may be a casing string, and the 'tubular' may be the wellbore 306 (or surrounding surface 307). The tool 302 may be like that of other tool embodiments described herein (e.g., 202), and may only be discussed in brevity.

Although not limited, the downhole tool 302 may be an open hole or casing annulus packer. As such, the downhole tool 302 may be used in cementing (or comparable) operations. For example, the downhole tool 302 may be run as part of a casing string, and set in a desired position. Upon setting, a port collar (not shown here) may be opened, and cement may flow and settle in a surrounding annulus 390 for "off-bottom" or "stage" cementing.

The downhole tool 302 may be suitable for use in a downhole system where an annulus of greater significance is present. The size of the annulus may be dictated by the presence of a narrowance or restriction that may have a reduced (and may be significantly reduced) narrowance diameter.

As such, the downhole tool 302 may be suitable for variant downhole conditions, such as when multiple ID's are present within the tubular or wellbore 306. In order to perform a downhole operation, such as an open hole cement job, the tool 302 may be by necessity operable in a manner whereby it may be moved (or run-in) through a narrowed ID, and yet still be operable for successful setting within a second ID.

In an embodiment, the first ID of a first portion of the tubular 306 and a second ID of a second portion of the tubular 306 may be the same. In this respect, a narrowing may have a third ID that is less than the first ID/second ID, and the tool 302 needs to have a narrow enough run-in OD to pass therethrough, yet still be functional to properly set within the second portion.

For such an expansion, normally an inflatable packer might be a preferred choice; however, embodiments herein provide for mechanical packer setting that utilizes an innovative backup element system 330. In this respect, the tool 302 may need to have a narrow enough run-in OD to pass through the first portion, yet still properly set within the second portion, and properly form a seal 325 against the inner surface 307 (of tubular 306) in the tool annulus 390. The formed seal 325 may withstand pressurization of greater than 10,000 psi. In an embodiment, the seal 325 withstands pressurization in the range of about 5,000 psi to about 18,000 psi.

The downhole tool 302 may include a mandrel 314 having a setting piston engaged therewith. The setting piston may include one or more surfaces (e.g., shoulder) with varied diameter. When such surface is exposed pressurized fluid source, this may act on the surface, and move the piston against a compressing member 304. Either of the ends of the tool 302 may have a compressing member 304 abutted thereagainst, ultimately resulting in compressing the components of the tool 302 together. The force may be suitable to completely set the downhole tool 302. The piston may be a hydraulic piston, which may be connect with or integral to the mandrel 302.

The downhole tool 302 may have a backup ring system 330. One of skill would appreciate that each end of the downhole tool 302 may have the backup ring system 330. The (backup) ring system or assembly 330 may include an at least one expansion ring or fingered member 331. There may be a second expansion ring or fingered member 331*a*. The fingered members may have respect fingers 332, 332*a* configured to extend away from the main (annular) body 333, 333*a*. Each finger(s) 332, 332*a* may be separated from an adjacent finger by (longitudinal) grooves, which may extend from a finger outer surface 349 to a finger inner surface 349*a*.

The fingered members 331, 331*a* may have a nested configuration. It is worth noting that the other end of the tool 302 may have a similar or identical system 230, thus providing a symmetrical component configuration.

As mentioned, the members 331 and 331*a* may be slotted or grooved, which may provide easier expansion of the fingers. The nesting and fingered configuration may be like that as described herein, including such as that shown in FIG. 2B. This type of configuration, with the slots in each fingered member positioned to straddle the slots from the other member, may facilitate easier expansion, as well as improved backup and holdability.

Each fingered member 331, 331*a* may have a respective annular groove 339, 340. The annular groove 339, 340 may be on an outer surface (e.g., 349) of either respective body, fingers, or at the point where the fingers extend away from the body.

The presence of the grooves 339, 340 may provide for the members 331, 331*a* to deploy from the outside end of each member, which may allow the main part of each "finger" to stay relatively straight. This shape when set may provide added structural integrity in the finger section of the members 331, 331*a*, and may better resist bending backwards under high loads from the stack of proximate elements.

There may be more than one setting piston. For example, the string may include a first piston with a first setting stroke for compressing against a first end of the tool. The string may include a second piston with a second setting stroke for compressing against the second end of the tool. The result of compressing together is the urging (radially) outwardly of one or more components, such as the members 331, 331*a*, and one or more of the elements 341, 343, etc.

The end cap or ring 342 may also be deformable; however, the amount of deformation may be to a much lesser extent than either of the members 331, 331*a*. In embodiments, end cap 342 may not be slotted. The design and function of the end cap 342 may be to supply mechanical support to the hinge areas of the member(s) 331, 331*a*, especially where the maximum bending loads may be incurred. The end cap 342 made be made from highly ductile material that may also be deformable under load, such as steel.

The center element 341 may be elastomeric. The element 341 may be proximate or otherwise adjacent to one or more adjacent elements or sections 343 *a, b, c*, etc. that may deploy independently of each other. Any of the elements 341, 343 *a, b*, etc. may be multiple-durometer. In embodiments, harder durometer elements may be used on the external ends of the tool 302, working into the softest elastomer element in the middle. The elements 343*b* and 343*c* adjacent to the member 332*a* may be the hardest. As such, the support elements 343*b* and 343*c* may provide the highest level of extrusion resistance, while the softer inboard element 343*a* may provide the best sealing properties.

Between the last element 343*c* and the second member 334*a*, there may be a spacer member 335. The spacer 335 may be a solid durable material, such as hard rubber or a plastic like Teflon (PTFE). The spacer 335 may provide protection from the fingers 332*a* biting into the element 343*c*.

Figure 3A:
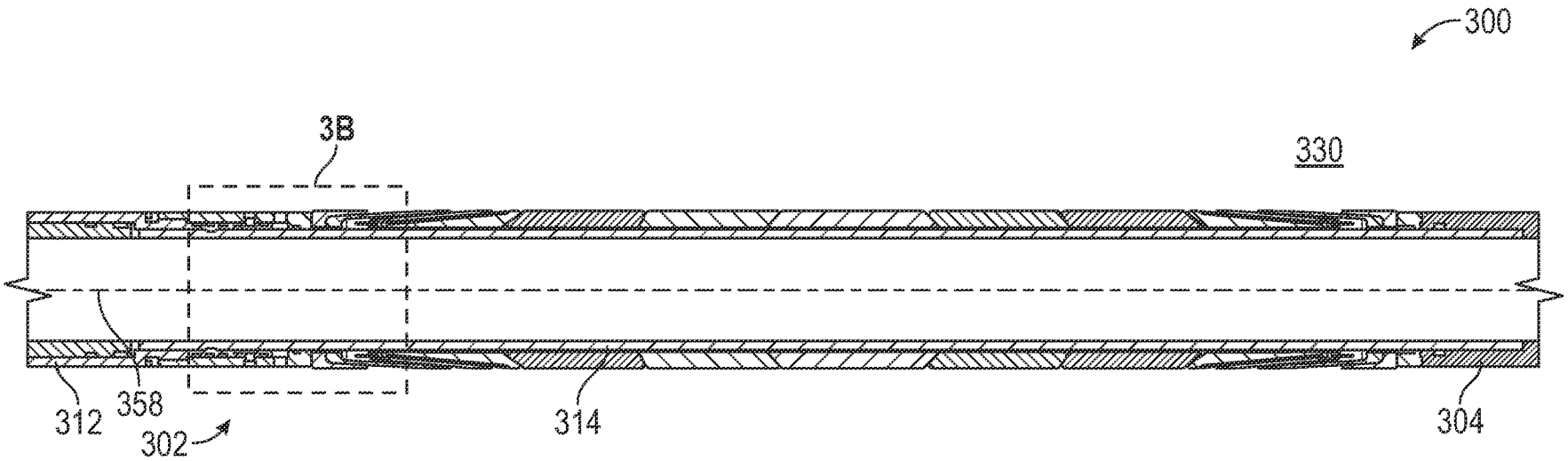
FIG. 3A shows a longitudinal cross-sectional view of a downhole tool in a run-in-hole (RIH) position, according to embodiments of the disclosure.
Figure 3B:
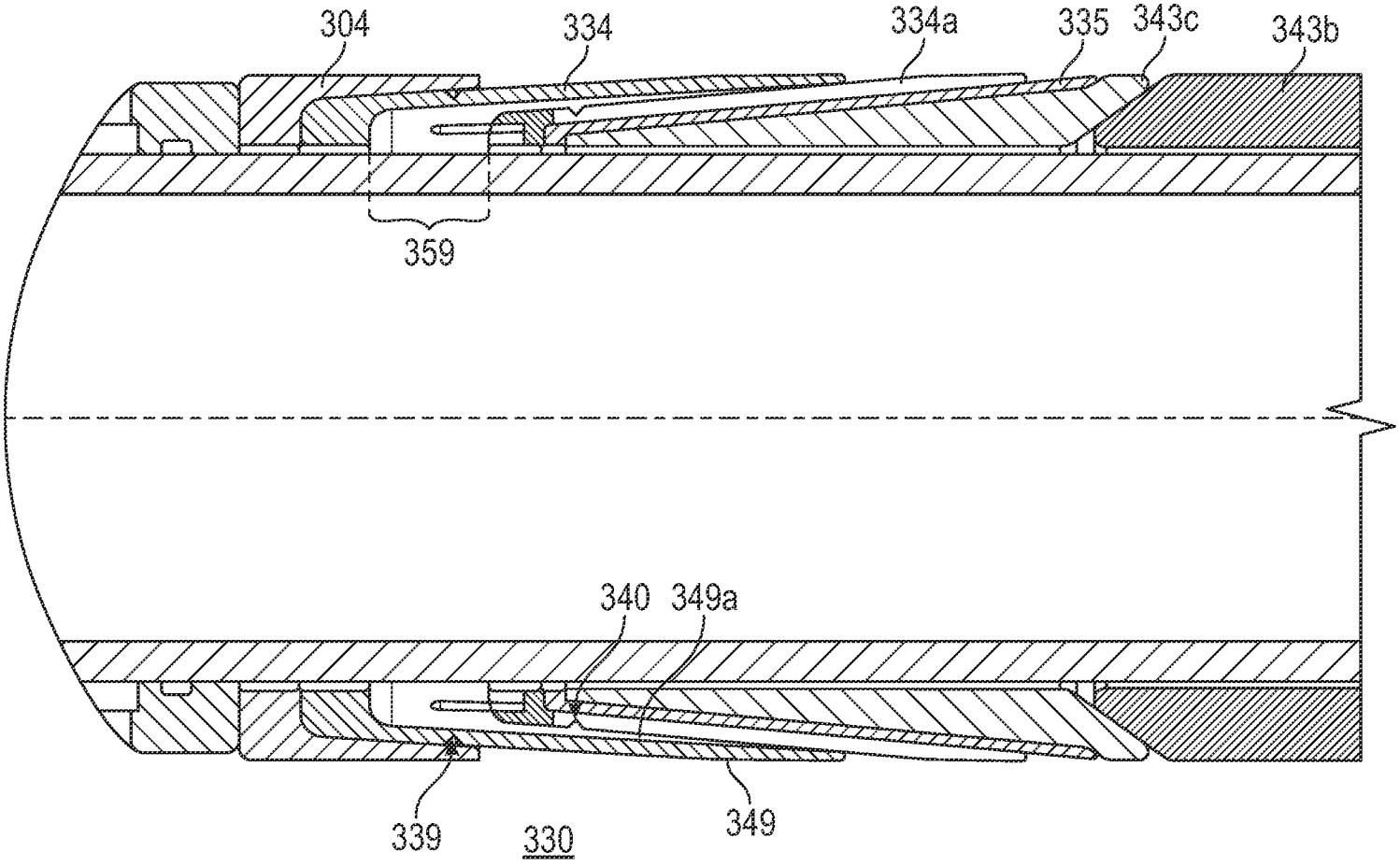
FIG. 3B shows a close-up side cross-sectional view of a first fingered member of the tool of FIG. 3A in a staggered, nested engagement with a second fingered member, according to embodiments of the disclosure.
Figure 3C:
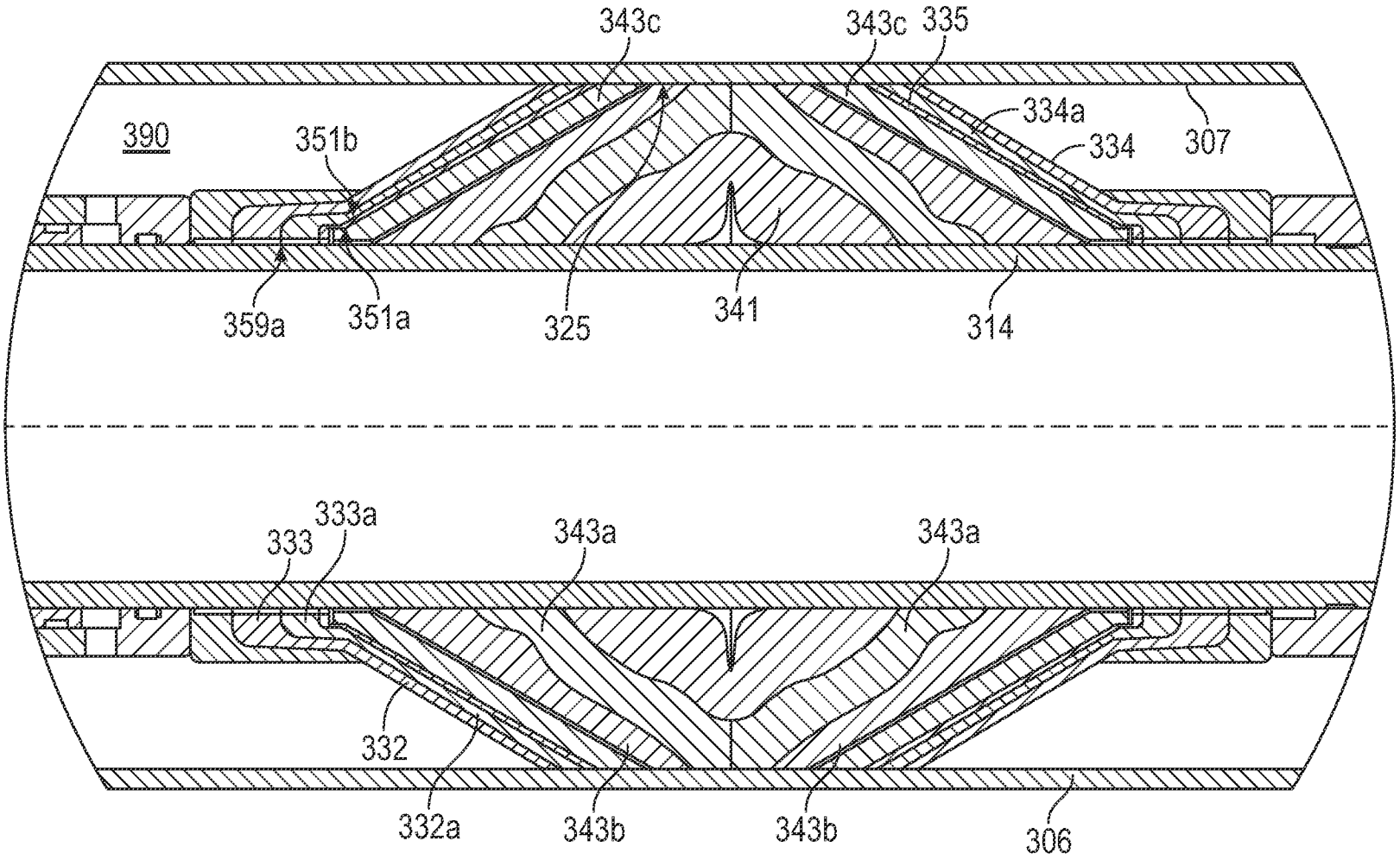
FIG. 3C shows a longitudinal side cross-sectional view of the downhole tool of FIG. 3A in a set position according to embodiments of the disclosure.

The cross-section views of FIGS. 3A-3C show the fingered members 331, 331*a* with the hinge point designed into the members 334, 334*a* to allow the members to deploy with less axial setting force. The nested configuration of the members 334, 334*a* may provide maximum support to the center element 341.

As shown in FIG. 3C, the center element 341 in the set position showing the fingered members 331, 331*a* providing structural support and anti-extrusion barrier to the center element 341. The end cap 342 may deform slightly and provides structural support to the fingered members at the hinge point(s) 351, 351*a*.

As shown in FIG. 3C, the end of the center element 341 in the set position, and the relative position of the expanded fingers 332, 332*a*, which may provide full circumference support (directly or indirectly) to the center element 341.

Figure 3D:
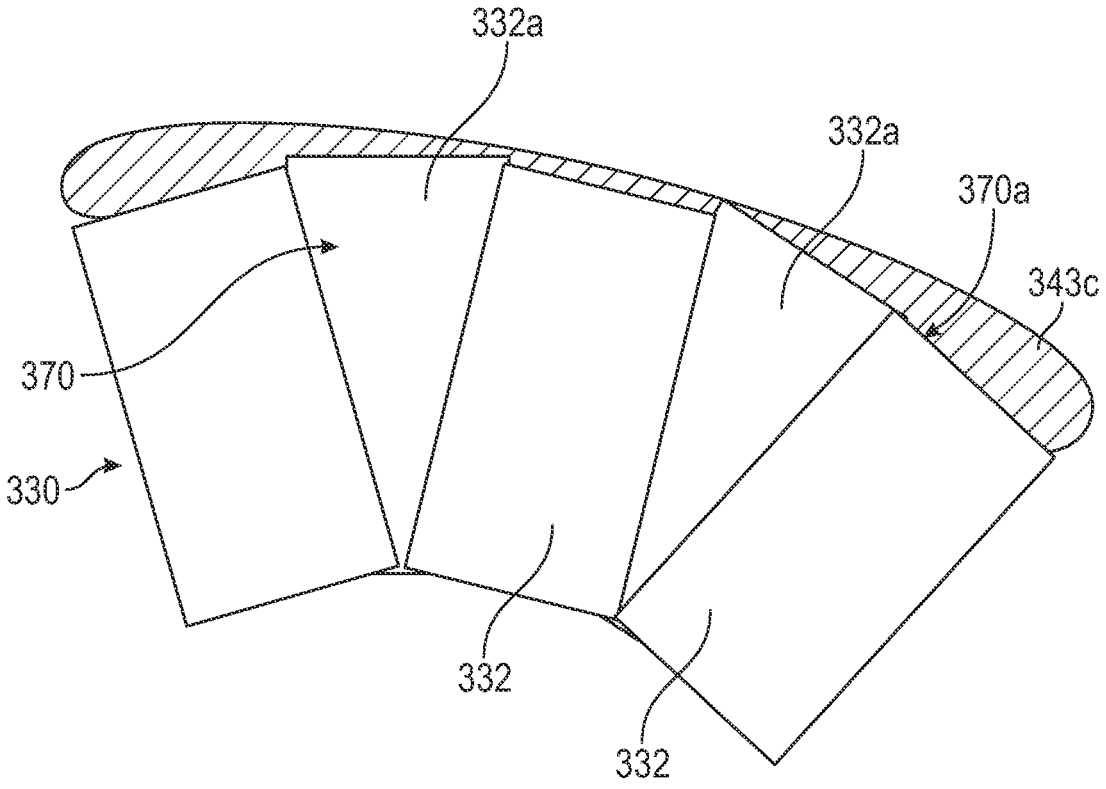
FIG. 3D shows a partial side view of nested fingered members of the downhole tool of FIG. 3C according to embodiments of the disclosure.

FIG. 3D shows the how the nested members 331, 331*a* have their respective fingers 332, 332*a* expanded in such a relative way that one set of fingers 332*a* occludes or otherwise blocks an extrusion gap 370 between fingers 332. Analogously, the fingers 332 occlude or otherwise block an extrusion gap 370*a* between fingers 332*a*. As a result of the offset configuration, the elements (e.g., element 343*c*) are prevented from extruding through the gaps 370, 370*a*.

In embodiments, in a RIH position, there is a clearance 359 between an outer bottom end 373 of the second fingered member 331*a* and an inner bottom end 374 of the first fingered member 331 (see FIG. 3B). In a set position, the clearance becomes closed 359*a*, and the outer bottom end 373 and the inner bottom end 374 are in contact (see FIG. 3C).

Advantages

Embodiments of the downhole tool may advantageously provide for high expansion rates while maintaining seal integrity. A relatively low setting force need only required to deploy the fingered members.

While preferred embodiments of the disclosure have been shown and described, modifications thereof can be made by one skilled in the art without departing from the spirit and teachings of the disclosure. The embodiments described herein are exemplary only, and are not intended to be limiting. Many variations and modifications of the disclosure disclosed herein are possible and are within the scope of the disclosure. Where numerical ranges or limitations are expressly stated, such express ranges or limitations should be understood to include iterative ranges or limitations of like magnitude falling within the expressly stated ranges or limitations. The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the preferred embodiments of the present disclosure. The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

What is claimed is:

1. A downhole tool for use in a wellbore, the downhole tool comprising:

a packer chassis comprising:

a distal end; a proximate end; and a chassis outer surface, a central element;

a plurality of support elements;

a first fingered member comprising a plurality of fingers having respective longitudinal slots therebetween;

a second fingered member proximate the first fingered member, and comprising a plurality of second member fingers having respective midpoints; and an end cap, wherein the plurality of support elements, the first fingered member, and the second fingered member are held between the central element and the end cap, wherein the longitudinal slots of the first fingered member are proximately aligned to the respective finger midpoints of the second fingered member wherein in a run-in-hole position, there is a clearance between an outer bottom end of the second fingered member and an inner bottom end of the first fingered member, and wherein in a set position, the outer bottom end and the inner bottom end are in contact.

2. The downhole tool of claim 1, wherein each of the first fingered member and the second fingered member comprise an outer annular groove formed in the region where respective member fingers extend away from a member body.

3. The downhole tool of claim 1, wherein one of the plurality of support elements is proximate the second fingered member, and wherein a plastic spacer is disposed between the one support element and the second fingered member.

4. The downhole tool of claim 1, wherein in a set position a gap formed between respective expanded second member fingers is occluded by a first member finger proximate thereto.

5. The downhole tool of claim 1, wherein the downhole tool is coupled with a casing string, and wherein in a set position, the downhole tool forms a seal against an external surface.

6. A downhole tool for use in a wellbore, the downhole tool comprising:

a packer chassis;

a central element disposed around the packer chassis;

a plurality of support elements disposed around the packer chassis;

a first fingered member disposed around the packer chassis, and further comprising a plurality of fingers having respective longitudinal slots therebetween;

a second fingered member disposed around the packer chassis and proximate the first fingered member, and further comprising a plurality of second member fingers having respective midpoints; and an end cap disposed around the packer chassis, and engaged with the first fingered member, wherein the plurality of support elements, the first fingered member, and the second fingered member are held between the central element and the end cap, wherein the longitudinal slots of the first fingered member are proximately aligned to the respective finger midpoints of the second fingered member, and wherein each of the first fingered member and the second fingered member comprise an outer annular groove formed in the region where respective member fingers extend away from a member body.

7. The downhole tool of claim 6, wherein a backup ring assembly is disposed on the other end of the packer chassis, wherein the backup ring assembly comprises a respective first fingered member, a respective second fingered member, and a respective end cap.

8. The downhole tool of claim 7, wherein in a run-in-hole position, there is a clearance between an outer bottom end of the second fingered member and an inner bottom end of the first fingered member, and wherein in a set position, the outer bottom end and the inner bottom end are in contact.

9. The downhole tool of claim 8, wherein one of the plurality of support elements is proximate the second fingered member, and wherein a plastic spacer is disposed between the one support element and the second fingered member.

10. The downhole tool of claim 8, wherein in a set position a gap formed between respective expanded second member fingers is occluded by a first member finger proximate thereto.

11. The downhole tool of claim 10, wherein the downhole tool is coupled with a casing string, and wherein in a set position, the downhole tool forms a seal against an external surface.

12. A downhole tool for use in a wellbore, the downhole tool comprising:

a packer chassis;

a central element disposed around the packer chassis;

a plurality of support elements disposed around the packer chassis;

a first fingered member disposed around the packer chassis, and further comprising a plurality of fingers having respective longitudinal slots therebetween;

a second fingered member disposed around the packer chassis and proximate the first fingered member, and further comprising a plurality of second member fingers having respective midpoints; and an end cap disposed around the packer chassis, and engaged with the first fingered member, wherein the plurality of support elements, the first fingered member, and the second fingered member are held between the central element and the end cap, wherein the longitudinal slots of the first fingered member are proximately aligned to the respective finger midpoints of the second fingered member, wherein each of the first fingered member and the second fingered member comprise an outer annular groove formed in the region where respective member fingers extend away from a member body, wherein one of the plurality of support elements is proximate the second fingered member, and wherein a plastic spacer is disposed between the one support element and the second fingered member.

13. The downhole tool of claim 12, wherein a backup ring assembly is disposed on the other end of the packer chassis, wherein the backup ring assembly comprises a respective first fingered member, a respective second fingered member, and a respective end cap.

14. The downhole tool of claim 12, wherein in a run-in-hole position, there is a clearance between an outer bottom end of the second fingered member and an inner bottom end of the first fingered member, and wherein in a set position, the outer bottom end and the inner bottom end are in contact.

15. The downhole tool of claim 12, wherein in a set position a gap formed between respective expanded second member fingers is occluded by a first member finger proximate thereto.

16. The downhole tool of claim 15, wherein the downhole tool is coupled with a casing string, and wherein in a set position, the downhole tool forms a seal against an external surface.

17. The downhole tool of claim 16, wherein the longitudinal slots of the second fingered member are proximately aligned to the respective finger midpoints of the first fingered member.

18. The downhole tool of claim 12, wherein the longitudinal slots of the second fingered member are proximately aligned to the respective finger midpoints of the first fingered member.

* * * * *